US005746889A

United States Patent [19]

Huovila et al.

[11] Patent Number: 5,746,889

[45] Date of Patent: May 5, 1998

[54] STOCK FEED SYSTEM FOR A MULTI-LAYER HEADBOX AND METHOD IN THE OPERATION OF A MULTI-LAYER HEADBOX

[75] Inventors: Jyrki Huovila; Ari Linsuri, both of Muurame, Finland

[73] Assignee: Valmet Corporation, Helsinki, Finland

[21] Appl. No.: 754,527

[22] Filed: Nov. 21, 1996

[30] Foreign Application Priority Data

Oct. 18, 1996 [FI] Finland ..... 964180

[51] Int. Cl.[6] ..... D21F 9/00; D21F 11/04

[52] U.S. Cl. ..... 162/216; 162/300; 162/301; 162/336; 162/343

[58] Field of Search ..... 162/300, 301, 162/216, 336, 339, 343

[56] References Cited

U.S. PATENT DOCUMENTS

| | | | |
|---|---|---|---|
| 2,077,017 | 4/1937 | Schacht | 162/343 |
| 2,315,892 | 4/1943 | Booth | 92/21 |
| 3,266,974 | 8/1966 | Staver | 162/343 |
| 3,598,696 | 8/1971 | Beck | 162/343 |
| 3,833,465 | 9/1974 | Campbell | 162/380 |
| 4,021,295 | 5/1977 | Schmaeng | 162/125 |
| 4,086,130 | 4/1978 | Justus | 162/123 |
| 4,376,014 | 3/1983 | Bergstrom | 162/336 |
| 4,384,922 | 5/1983 | Stotz | 162/259 |
| 4,445,974 | 5/1984 | Stenberg | 162/300 |
| 4,744,866 | 5/1988 | Koponen et al. | 162/203 |
| 4,889,594 | 12/1989 | Gavelin | 162/130 |
| 5,074,965 | 12/1991 | Keskiivari et al. | 162/216 |
| 5,401,363 | 3/1995 | Begemann et al. | 162/164.6 |
| 5,405,501 | 4/1995 | Phan et al. | 162/127 |
| 5,466,340 | 11/1995 | Begemann et al. | 162/216 |

FOREIGN PATENT DOCUMENTS

| | | | |
|---|---|---|---|
| 0003377 | 8/1979 | European Pat. Off. . | |
| 0312512 | 4/1989 | European Pat. Off. . | |
| 0479141 | 4/1992 | European Pat. Off. . | |
| 0 651 092 A1 | 5/1995 | European Pat. Off. | 162/343 |
| 862288 | 5/1986 | Finland . | |
| 78949 | 11/1987 | Finland . | |
| 884763 | 4/1989 | Finland . | |
| 934793 | 10/1993 | Finland . | |
| 3720618 | 1/1988 | Germany . | |
| 4031310 | 4/1992 | Germany . | |
| 8503316 | 8/1985 | WIPO . | |

*Primary Examiner*—Donald E. Czaja
*Assistant Examiner*—Jose A. Fortuna
*Attorney, Agent, or Firm*—Steinberg, Raskin & Davidson, P.C.

[57] ABSTRACT

A stock feed system for a multi-layer headbox in which a stock concept is passed into each inlet header in the multi-layer headbox. The stock concepts are produced out of the same fresh stock by adding chemicals and fillers to divided portions of that fresh stock. To this end, the system includes a single fresh-stock container, and stock lines into which the fillers, additives and equivalent are added in compliance with the requirements of each concept. The stock feed system also includes at least one fiber distributor for transferring long fibers out of the stock that is destined to form the surface layer of the paper into the stock that is destined to form a layer placed in the interior of the paper, preferably the middle layer. Fibers having a shorter length, compared with the average distribution of fibers in the basic stock derived from the stock container, are allowed to remain in the surface layer of the paper/board, and longer fibers, compared with the average distribution of fibers, are allowed to remain in the middle layer and/or are transferred into the middle layer.

17 Claims, 4 Drawing Sheets

STOCK FEED SYSTEM FOR A MULTI-LAYER HEADBOX AND METHOD IN THE OPERATION OF A MULTI-LAYER HEADBOX

FIELD OF THE INVENTION

The invention relates to a stock feed system for a multi-layer headbox and a method in the operation of a multi-layer headbox.

BACKGROUND OF THE INVENTION

The current assignee's Finnish Patent No. 92,729 describes a so-called single-stock system in the operation of a multi-layer headbox. The single-stock system comprises a multi-layer headbox having at least two separate, vertically-spaced inlet headers or equivalent, e.g., such that a corresponding amount of layers of a web layers produced by the headbox can be provided. For the inlet headers, the different stocks are formed out of the same fresh stock, which is derived from one and the same stock container placed in connection with the headbox. The fresh stock that is passed out of the single stock container is subsequently divided into two or more component flows. Chemicals and/or additives are passed into the component flows that are fed into the multi-layer headbox, the purpose of the addition of chemicals and/or additives being to enable and facilitate control of the quality and/or the economy of the production of different paper grades. The system is quite simple, and its construction is particularly advantageous. Fillers can be added to the stock derived from one stock container in an optimal manner. In the system, in direct connection with the multi-layer headbox, just one basic stock is dealt with, to which the fillers and possibly also regulated quantities of dilution water and other retention agents are added in compliance with the requirements of each layer.

OBJECTS AND SUMMARY OF THE INVENTION

It is an object of the present invention to provide a new and improved single-stock stock feed system for a multi-layer headbox.

It is another object of the present invention to provide a new and improved method for supplying a multi-layer headbox by means of a single-stock stock feed system.

In order to achieve these objects, and others, in the stock feed system for a multi-layer headbox in accordance with the invention, a fractioning system for the stock is added to the type of single-stock system described in the current assignee's Finnish Patent No. 92,729 as described above, i.e., fractioning based on the fiber lengths so that the short fibers in the stock are allowed or caused to remain in the surface layer/layers, i.e., in the stock which will be passed to the inlet headers which provide the surface layer/layers of the web, and the long fibers are transferred from the surface layer into the middle or intermediate layer/layers, i.e., into the stock which will be passed to the inlet headers which provide the middle layer/layers of the web. Thus, in general, there is some separation of stock fibers in the stock flows leading to the inlet headers of the headbox according to their length and redirection or rearrangement of the separated stock fibers to specially desired ones of the inlet headers in the headbox.

In the fractioning system, a certain portion fractioned from the stock is passed out of one component flow derived from the single stock container into another discrete component flow derived from the same stock container. For example, it has been realized that the quality of the printing face of paper can be improved by transferring the long fibers from the surface layer/layers into the middle layer/layers. It is also possible to operate the fractioning system so that, while long fibers are transferred into the middle layer, correspondingly short fibers are transferred from the middle layer into the surface layer/layers. On the whole, different variations of fractioning are possible in an attempt to obtain properties of certain nature of the paper. For example, by means of a particular screen of a certain sort, in a multi-layer headbox that comprises three layers, the accept from the screen in the middle layer can be passed to a surface layer, whereas the reject of the screen concerned is allowed to remain in the middle layer.

In view of the foregoing, out of the basic stock of the single-stock system described in the current assignee's Finnish Patent No. 92,729, which stock contains substantially all the fibers to be used for the paper to be produced, at least two different components are formed, of which one component contains fibers longer than average, compared with the distribution of fiber length in the basic stock, and the other stock concept contains essentially fibers shorter than average. Moreover, the procedure is such that the short fibers remain in the surface layer/layers, and that long fibers are transferred from the stock lines of the surface layers into the middle layer/layers.

More particularly, in accordance with the invention, the stock feed system of the multi-layer headbox comprises at least one such fiber distributor by whose means long fibers are transferred out of the stock that forms the surface layer of the paper into the stock that forms a layer placed in the interior of the paper, preferably the middle layer, in which connection fibers of shorter length, compared with the average distribution of fibers in the basic stock derived from the stock container, are allowed to remain in the surface layer of the paper/board, and longer fibers, compared with the average distribution of fibers, are allowed to remain in the middle layer and/or are transferred into the middle layer.

In one embodiment of the method in accordance with the invention, the headbox includes a plurality of stock inlet headers each receiving an individual stock concept and out of which the stock flows further through a distribution manifold into a turbulence generator and further into a slice cone to form a web upon discharge from the slice cone. The stock of each inlet header is prepared from a single fresh stock source by adding the necessary chemicals and fillers into divided portions of the fresh stock in connection with an approach pipe system of the headbox. In accordance with the teachings of the invention, longer fibers, in comparison to an average distribution of fibers in the fresh stock, are transferred from flows lines through which stock flows into certain inlet headers from which surface layers of the web will be produced to at least one flow line through which stock flows into a respective one of the inlet headers from which an intermediate layer of the web will be produced. In certain embodiments, the stock in the at least one flow line through which stock flows into the respective one of the inlet headers from which the intermediate layer of the web will be produced may be screened, e.g., by a machine screen, to separate shorter fibers from longer fibers, in comparison to the average distribution of fibers in the fresh stock, and the separated shorter fibers are transferred to the flows lines through which stock flows into the inlet headers from which surface layers of the web will be produced. Similarly, the stock in the flow lines through which stock flows into the inlet headers from which surface layers of the web will be produced can be screened to separate longer fibers from shorter fibers prior to the step of transferring the longer fibers from the flows lines through which stock flows into the inlet headers from which surface layers of the web will be produced to the at least one flow line through which stock flows into the respective inlet header from which an intermediate layer of the web will be produced.

Another embodiment of the invention is directed to a method for delivery stock to a multi-layer headbox including a plurality of stock inlet headers such that each receives an individual stock concept. This method comprises the steps of directing a flow of fresh stock from a single container, dividing the flow of fresh stock into a first and second surface stock flows and at least one intermediate stock flow, directing the first and second surface stock flows into first and second inlet headers arranged such that a surface layer of a web is formed from the stock of the first and second inlet headers upon discharge of the stock from the headbox, directing the at least one intermediate stock flow into a respective one of the inlet headers arranged such that an intermediate layer of the web between the surface layers of the web is formed from the stock of the respective inlet header upon discharge of the stock from the headbox, and adding chemicals, fillers and/or additives to the first and second stock flows and the at least one intermediate stock flow. Moreover, in accordance with the teachings of the invention, longer fibers, in comparison to an average distribution of fibers in the fresh stock, are transferred from the first and second surface stock flows to the at least one intermediate stock flow. As before, the at least one intermediate stock flow can be screened to separate shorter fibers from longer fibers, in comparison to the average distribution of fibers in the fresh stock, and the separated shorter fibers transferred to the first and second surface stock flows. It is also possible to screen the first and second stock flows to separate longer fibers from shorter fibers prior to the step of transferring the longer fibers from the first and second stock flows to the at least one intermediate stock flow.

In the following, the invention will be described with reference to some preferred embodiments of the invention illustrated in the figures in the accompanying drawings. The invention is however, not confined to the illustrated or described embodiments of the invention alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
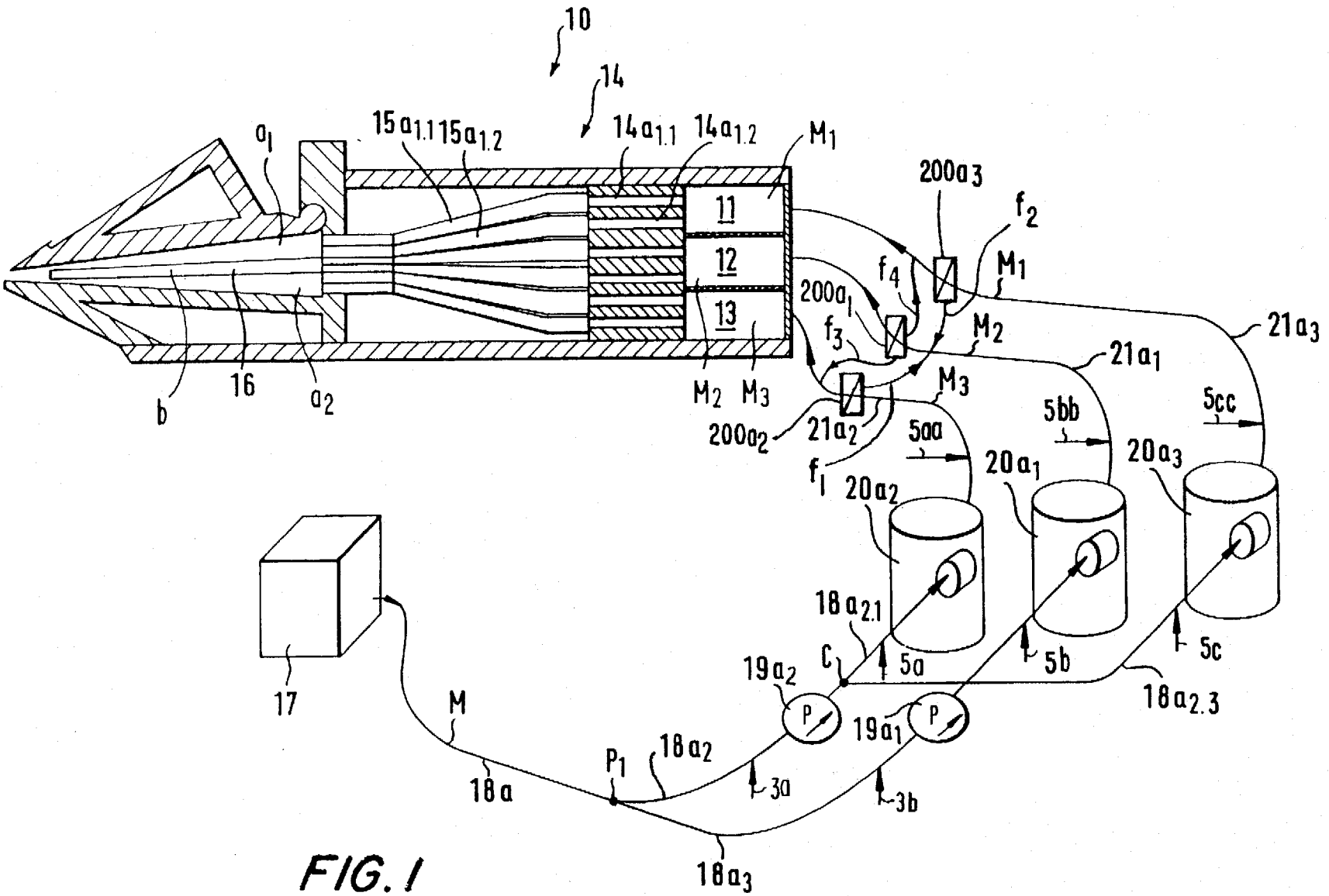
FIG. 1 shows a first embodiment of the invention in which the stock flow derived from the fresh-stock container is divided into three component flows, which are passed further, after being supplied with chemicals and fillers, into different inlet headers in the multi-layer headbox.

Referring to the accompanying drawings wherein the same reference numerals refer to the same or similar elements, in the following description, the term "middle layer" means the stock and the distribution line or distribution lines related to the stock remaining between the surface layers of the stock and which will form the middle or intermediate layer/layers of the web, such as a paper web, after being passed to the multi-layer headbox. Thus, there can be one or more middle layers. Similarly, the term "surface layers" means the stock and the stock line or stock lines which form(s) the surface layer/layers in the web, such as a paper or board web, after being passed to the multi-layer headbox.

FIG. 1 is a schematic illustration of a first embodiment of the invention, which is favorably suitable for the production of SC-paper. In the embodiment of FIG. 1, a paper web or a board web is formed which comprises surface layers $a_1$ and $a_2$ as well as a middle or intermediate layer b. By means of the arrangement of the invention, the web is formed such that, in its middle layers $a_1$ and $a_2$ there are shorter fibers, and in the middle layer b, there are longer fibers. In this manner, good surface and printing properties are obtained for the paper. When screens are spoken of in the following description, what is meant is, in connection with fractioning of stock, such a stock fractioning device in general by whose means the stock is divided into different flows based on the fiber length, i.e., one flow having longer fibers and the other flow having shorter fibers. The use of screens enables the long fibers to be transferred into the middle portion of the web from the stock destined to produce the surface layers of the web, and the short fibers to remain in the stock destined to produce the surface layers of the web and be transferred from the middle portion of the web into the surface layers and of the web.

As shown in FIG. 1, a multi-layer headbox 10 comprises three vertically-arranged inlet headers, namely the inlet headers 11, 12 and 13 arranged one on top of the another. From the inlet header 11, the stock $M_1$ is passed through a tube bank such as a distribution manifold 14 having a plurality of distributor tubes $14a_{1.1}$, $14a_{1.2}$, . . . into another tube bank such as a turbulence generator 15 and particularly into turbulence tubes $15a_{1.1}$, $15a_{1.2}$, . . . and further into a slice cone 16. Each distributor tube of the distributor manifold 14 is preferably aligned with a respective one of the turbulence tubes of the turbulence generator 15. From the inlet header 12, the stock $M_2$ is passed through the distribution pipes $14a_{2.1}$, $14a_{2.2}$, . . . of the distribution manifold 14 into the turbulence generator 15 and particularly into a respective, aligned one of its turbulence tubes $15a_{2.1}$, $15a_{2.2}$, . . . and further into the slice cone 16. Similarly, from the inlet header 13, the stock $M_3$ is passed through the distribution pipes $14a_{3.1}$, $14a_{3.2}$, . . . of the distribution manifold 14 into the turbulence generator 15 and particularly into a respective, aligned one of the turbulence tubes $15a_{3.1}$, $15a_{3.2}$, . . . and further into the slice cone 16. Thus, by means of the multi-layer headbox shown in FIG. 1, the paper is formed out of three stock concepts $M_1$, $M_2$ and $M_3$ in which case the web will comprise three layers formed out of potentially different stock concepts. The distributor manifold and turbulence generator are not essential in all embodiments of the invention, i.e., other headbox configurations can be used in the connection with the stock feed system for a multi-layer headbox in accordance with the invention.

The equipment comprises a single stock system, in which the stocks $M_1$, $M_2$ and $M_3$ are formed out of the same fresh stock M. Thus, in the single-stock system the different stocks for the multi-layer headbox are prepared out of one and the same fresh stock, i.e., a single fresh stock storage tank or container, by separately adding the necessary chemicals/ fillers to divided portions of the stock formed in connection with the approach pipe system of the headbox. While, in conventional prior art constructions, there are several fresh-stock lines and fresh-stock containers, which entail the storage of fresh stock between the initial source and the headbox, in the method and apparatus in accordance with the present invention, the different layers are formed out of the same fresh stock M, which is derived from one fresh-stock container 17. As shown in FIG. 1, the fresh stock M is made to flow out of the fresh-stock container 17 along a line 18*a* and branched at a branching point $P_1$ (defined in a branching member) into two branch lines $\mathbf{18}a_1$ and $\mathbf{18}a_2$. In the embodiment shown in FIG. 1, in the branch line $\mathbf{18}a_2$, the chemical composition 3*a* is added to the stock M, and in the branch line $\mathbf{18}a_1$ the chemical composition 3*b* is added, for example, a filler or starch. In the lines $\mathbf{18}a_1$, $\mathbf{18}a_2$ the stocks are made to flow further by means of respective pumps $\mathbf{19}a_1$ and $\mathbf{19}a_2$ arranged in associated with the lines so that along the line $\mathbf{18}a_1$ the stock is passed into a machine screen $\mathbf{20}a_1$. A retention agent 5*b* is fed into the stock before the machine screen $\mathbf{20}a_1$ and a retention agent 5*bb* is fed into the stock after the machine screen. In this manner, good mixing of the retention agent(s) and the stock is achieved. Along a line $\mathbf{21}a_1$, the stock $M_2$ that has been formed is passed into the middle inlet header 12 in the multi-layer headbox.

From the line $\mathbf{18}a_2$ after the pump $\mathbf{19}a_2$, from the branch point C, there is a line $\mathbf{18}a_{2.1}$ to the machine screen $\mathbf{20}a_2$ and from the machine screen $\mathbf{20}a_2$, there is a line $\mathbf{21}a_2$ to the multi-layer headbox. Before the machine screen $\mathbf{20}a_2$, a retention agent 5*a* is fed into the line $\mathbf{18}a_{2.1}$ and after the machine screen $\mathbf{20}a_2$, a retention agent 5*aa* is fed into the line $\mathbf{21}a_2$. The stock flow $M_3$ is passed along the line $\mathbf{21}a_2$ into the inlet header 13 in the multi-layer headbox.

From the branch point C (defined in a branching member), the line $\mathbf{18}a_{2.3}$ passes to the machine screen $\mathbf{20}a_3$ and further to the multi-layer headbox. Into stock passing in the line $\mathbf{18}a_{2.3}$, a retention agent 5*c* is fed before the machine screen $\mathbf{20}a_3$, and a retention agent 5*cc* is fed into the line $\mathbf{21}a_3$ after the machine screen $\mathbf{20}a_3$. Along the line $\mathbf{21}a_3$, the stock flow $M_1$ is passed into the inlet header 11 in the multi-layer headbox.

In the system illustrated in FIG. 1, screens $\mathbf{200}a_1$, $\mathbf{200}a_2$ and $\mathbf{200}a_3$ are arranged between the machine screens $\mathbf{200}a_1$, $\mathbf{200}a_2$ and $\mathbf{200}a_3$, respectively. The reject from the screen $\mathbf{200}a_2$ of the stock line $\mathbf{21}a_2$ of the surface layer, which reject consists of long fibers, is passed along a transfer line $f_1$ into the line $\mathbf{21}a_1$ of the middle layer. Similarly, the accept from the screen $\mathbf{200}a_2$ of the surface layer, which accept consists of short fibers, is passed further in the line $\mathbf{21}a_2$ of the surface layer into the inlet header 13. The screen $\mathbf{200}a_1$ placed in the line $\mathbf{21}a_1$, i.e., in the line that leads to the inlet header which forms the middle layer in the web, divides the stock based on the length of the fibers so that the accept of the screen $\mathbf{200}a_1$ consists of long fibers, which are allowed to remain in the stock flow in the line 21*a*1, and similarly the short fibers from the screen $\mathbf{200}a_1$ are passed as reject along the line $f_3$ into the line $\mathbf{21}a_2$ of the surface layer, and also, as is shown in FIG. 1, into the line $\mathbf{21}a_3$ of the other surface layer along the line $f_4$. The screen $\mathbf{200}a_3$ placed in the line $\mathbf{21}a_3$ operates in the same way as the screen in the line $\mathbf{21}a_2$, i.e., so that the long fibers arriving from the screen $\mathbf{200}a_3$ as reject of the surface layer are transferred along the line $f_2$ into the middle layer into its line $\mathbf{21}a_1$, and the accept from the screen $\mathbf{200}a_3$, i.e., the stock that contains the short fibers, is made to flow further in the line $\mathbf{21}a_3$. In sum, the fibers through all of the lines $\mathbf{21}a_1$, $\mathbf{21}a_2$ and $\mathbf{21}a_3$ are screened according to their length and then the longer fibers are caused to flow through the line or lines into the inlet header from which the middle layers of the web are formed and the shorter fibers are caused to flow through the lines into the inlet headers from which the surface layers of the web are formed. The lines $f_1$,$f_2$,$f_3$,$f_4$ constitute fiber transfer means for transferring fiber from one stock flow to another stock flow prior to the inlet headers, i.e., a stock which contains longer fibers or a stock that contains shorter fibers depending on the stock flow lines fluidly coupled by the individual lines.

Figure 2:
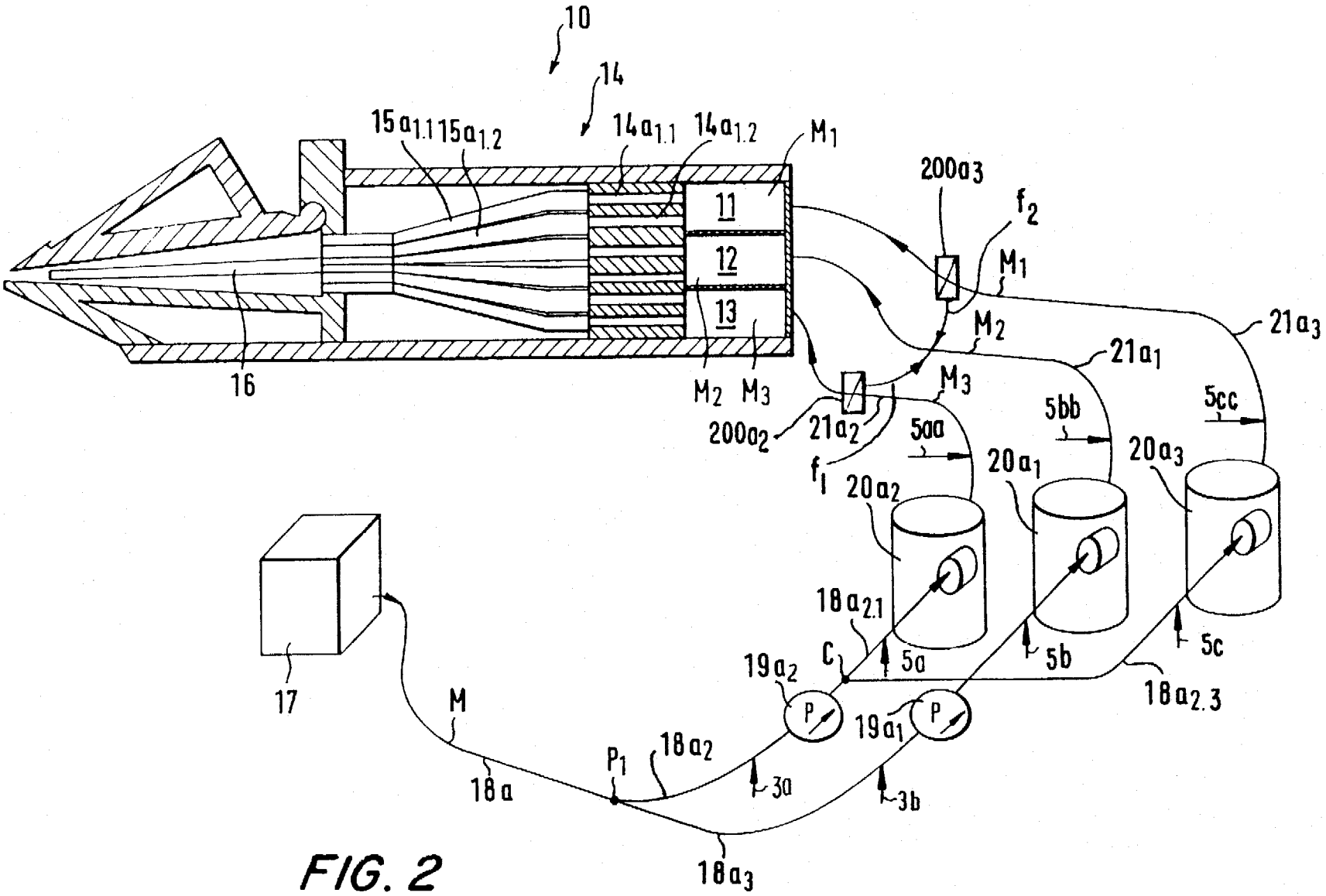
FIG. 2 shows a second embodiment of the stock feed system in accordance with the present invention for a multi-layer headbox.

FIG. 2 shows an embodiment of the invention in which the system comprises the screens $\mathbf{200}a_2$ and $\mathbf{200}a_3$ in the surface lines $\mathbf{21}a_2$ and $\mathbf{21}a_3$ only. The screens operate in the same way as in the embodiment of FIG. 1, so that by their means the stock flow arriving along the lines $\mathbf{21}a_2$ and $\mathbf{21}a_3$ into the screens $\mathbf{200}a_2$, $\mathbf{200}a_3$ is divided based on the length of the fibers so that stock that contains long fibers is transferred from the screens $\mathbf{200}a_2$, $\mathbf{200}a_3$ along the lines $f_1$ and $f_2$, respectively, into the center line $\mathbf{21}a_1$. On the other hand, the short fibers are allowed to remain in the lines $\mathbf{21}a_2$ and $\mathbf{21}a_3$, along which they pass further into their inlet headers in the multi-layer headbox. In contrast to the embodiment in FIG. 1, there is no separation and transfer of the short fibers in the stock flow through line $\mathbf{21}a_1$ to the surface stock flows.

Above, some preferred concepts of embodiment of the invention have been described. The invention is not confined to these embodiments. Rather, it is obvious that fractioning of the stock in a vertical system of coordinates of the web can also be carried out so that long fibers are transferred into the middle layer/layers of the web from one surface layer only. Within the scope of the invention, embodiments are also possible in which the multi-layer headbox comprises a number of lines which pass into a number of inlet headers placed one above the other, in which case long fibers can be transferred, besides from a surface layer, also from one or several stock lines that form a layer near the surface layer of the web into one or several stock lines that form the middle layer/layers in the paper web or board web. Thus, the invention can vary in many ways within the scope of the inventive idea described in the present patent application. Other pipe approach systems for dividing a stock flow from a single container to form a plurality of different stock concepts, e.g., without storage of the stock after the initial stock flow container, can also be used in the invention without deviating from the scope and spirit thereof It is also possible to redistribute fibers between only two layers, i.e., a top layer and a bottom layer in accordance with the teachings of the invention.

Figure 3A:
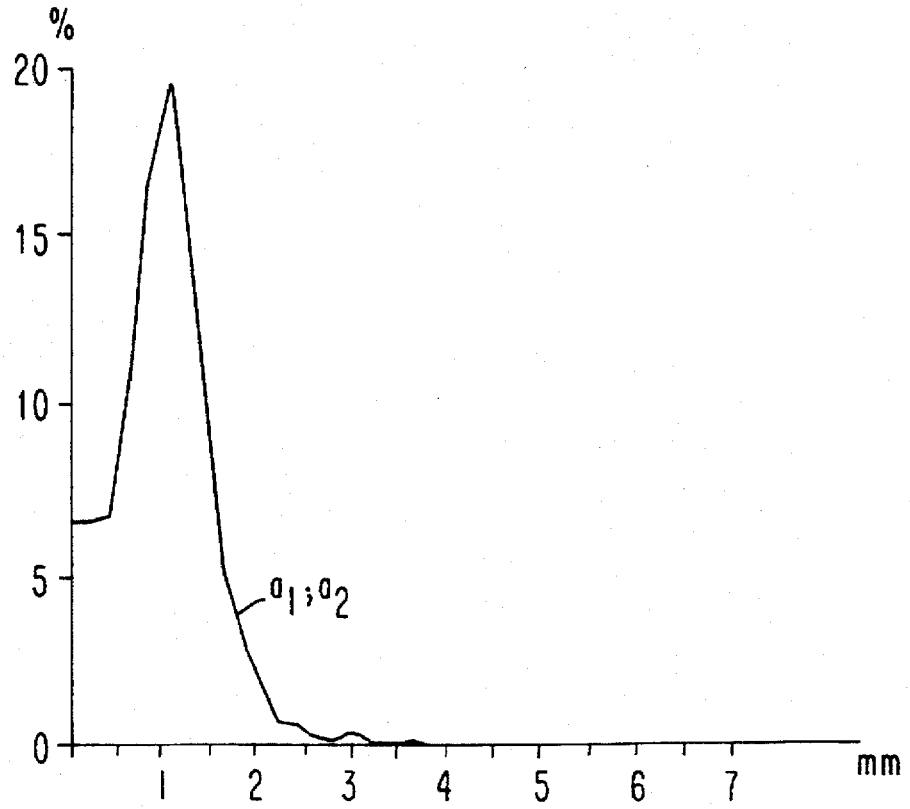
FIG. 3A illustrates the distribution of fiber lengths in the stock fed into the surface layers, which distribution has been achieved by separating the long fibers by means of a prior art technique.

FIG. 3A illustrates the distribution of fibre lengths in the stock flows forming the surface layers $a_1$ and $a_2$. The vertical axis represents the percentage proportion, and the horizontal axis represents the fibre length. It is seen that the long fibers have been for the most part removed from the stock.

Figure 3B:
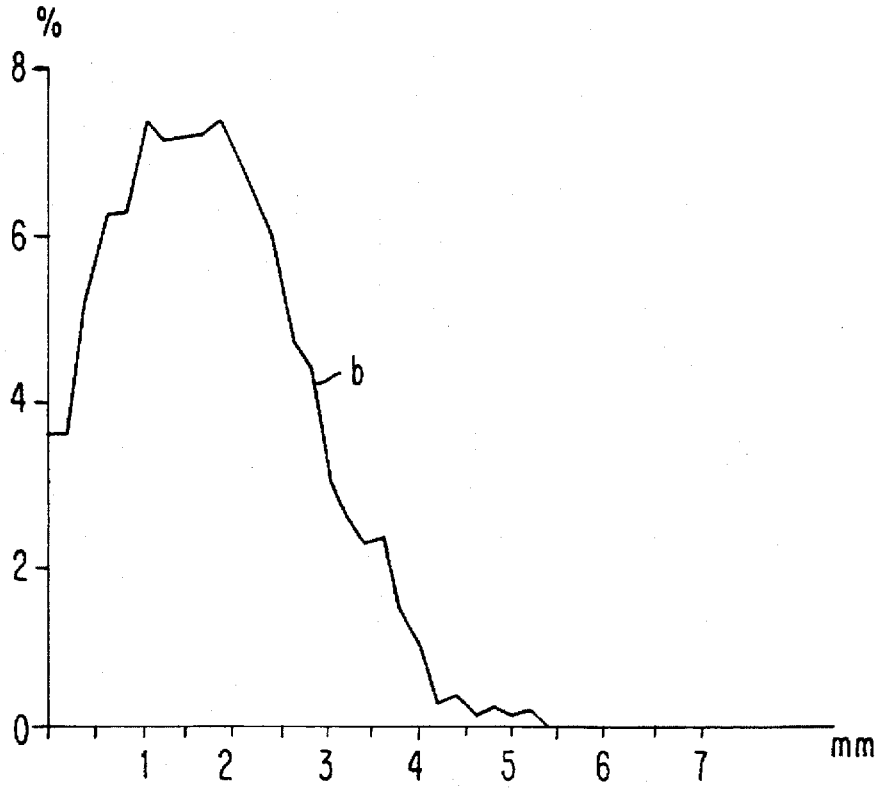
FIG. 3B illustrates the distribution of fiber lengths in the stock fed into the middle layer obtained by means of the same prior art technique.

FIG. 3B illustrates the distribution of fibre lengths in the stock flow forming the middle layer b. The vertical axis represents the percentage proportion, and the horizontal axis the fibre length. It is seen that there are longer fibers in the stock and less short fibers by percentage than in the stock flows forming the surface layers.

Figure 4:
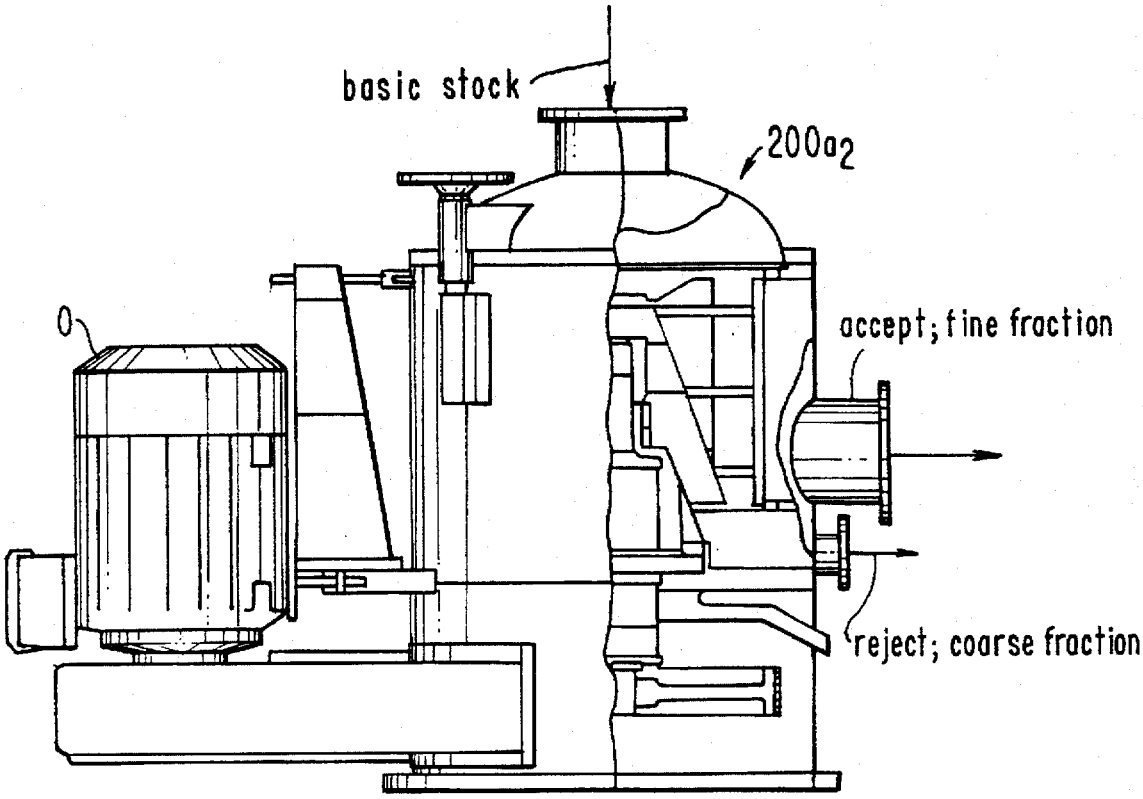
FIG. 4 illustrates the distribution operation of a conventional machine screen.

FIG. 4 shows an embodiment of a machine screen which can be used in accordance with the invention. The basic stock arriving in the machine screens is divided into the reject, which comprises a so-called coarse fraction, i.e., long fibers, and the accept, which comprises a fine fraction, i.e., short fibers. The conventional machine screen shown in FIG.

4 comprises an annular screen face in the middle of the device. The basic stock is passed into the middle of the screen, and the accept fraction, i.e., in this case, the fine fraction, which comprises short fibers, is pressed by means of the pressure of a pump through the annular screen face and to the side. The non-accepted fraction, i.e., the reject, is passed through the middle of the annular cylinder down and to the side. A motor O shown in the figure rotates the rotor and the attached pulse blades, which wipe along the screen face and keep it unblocked.

The examples provided above are not meant to be exclusive. Many other variations of the present invention would be obvious to those skilled in the art, and are contemplated to be within the scope of the appended claims.

We claim:

1. In a combination of a multi-layer headbox having a plurality of inlet headers and a stock feed system for the multi-layer headbox, the stock feed system comprising at least three stock flows, means for passing each of the stock flows into a respective one of the inlet headers of the multi-layer headbox and means for adding chemicals, additives and/or fillers to each of the stock flows, said at least three stock flows comprising first and second surface stock flows directed into respective ones of the inlet headers to form surface layers of a web produced by the headbox and at least one intermediate stock flow directed into a respective one of the inlet headers to form a respective intermediate layer of the web produced by the headbox between said surface layers of the web, the stock feed system comprising a single fresh-stock storage container, means for dividing a single flow of fresh stock from said container into said first and second stock flows and said at least one intermediate stock flow, and fiber distribution means for transferring fibers between said at least three stock flows before the inlet headers, said fiber distribution means comprising first transfer means for transferring longer fibers, in comparison to an average distribution of fibers in the single flow of fresh stock, from said first and second surface stock flows to said at least one intermediate stock flow whereby shorter fibers, in comparison to the average distribution of fibers in the single flow of fresh stock, in said first and second surface stock flows remain in said first and second surface stock flows to be passed into the respective one of the inlet headers.

2. The stock feed system of claim 1, wherein said fiber distribution means are structured and arranged to maintain longer fibers in said at least one intermediate stock flow to be passed into the respective one of the inlet headers.

3. The stock feed system of claim 1, wherein said fiber distribution means further comprise second transfer means for transferring shorter fibers from said at least one intermediate stock flow to at least one of said first and second surface stock flows.

4. The stock feed system of claim 1, wherein said fiber distribution means further comprise second transfer means for transferring shorter fibers from said at least one intermediate stock flow to both of said first and second surface stock flows.

5. The stock feed system of claim 1, wherein said at least one intermediate stock flow comprises a single intermediate stock flow, said stock flow passing means comprise first, second and third flow lines through which said first and second surface stock flows and said single intermediate stock flow are passed respectively into one of the inlet headers, said fiber distribution means further comprising screening means arranged in connection with each of said first and second flow lines for screening said first and second surface stock flows based on fiber length such that longer fibers are separate from shorter fibers, said first transfer means comprising transfer lines leading from said screening means into said third flow line and through which the longer fibers separated by said screening means are passed into said single intermediate stock flow.

6. The stock feed system of claim 1, wherein said fiber distribution means further comprise first screening means for screening said first surface stock flow based on fiber length such that longer fibers are separated from said first surface stock flow and second screening means for screening said second surface stock flow based on fiber length such that longer fibers are separated from said second surface stock flow, said first transfer means being arranged in connection with said first and second screening means for receiving the separated longer fibers from said first and second screening means and passing the separated longer fibers into said at least one intermediate stock flow.

7. The stock feed system of claim 6, wherein said first transfer means comprise first and second flow lines leading between said first and second screening means and a respective one of said at least one intermediate stock flow, respectively.

8. The stock feed system of claim 1, wherein said at least one intermediate stock flow comprises a single intermediate stock flow, said stock flow passing means comprise first, second and third flow lines through which said first and second surface stock flows and said single intermediate stock flow are passed respectively into one of the inlet headers, said fiber distribution means further comprising second transfer means for transferring shorter fibers from said single intermediate stock flow in said third flow line to at least one of said first and second surface stock flows in said first and second flow lines, respectively.

9. The stock feed system of claim 8, wherein second transfer means are structured and arranged to transfer shorter fibers from said single intermediate stock flow in said third flow line to both of said first and second surface stock flows in said first and second flow lines, respectively.

10. The stock feed system of claim 8, further comprising screening means for screening stock in said single intermediate stock flow in said third flow line based on fiber length such that a stock that container longer fibers constitutes an accept of said screening means and a stock that contains shorter fibers constitutes a reject of said screening means, said second transfer means comprising first and second transfer lines leading from said screening means to said first and second flow lines and fluidly coupled to said screening means such that the reject which consists of the stock that contains shorter fibers is carried through said first and second transfer lines from said screening means into said first and second flow lines, respectively.

11. The stock feed system of claim 8, wherein said first transfer means comprise transfer lines leading from said first and second flow lines to said third flow line and through which the longer fibers are passed into said single intermediate stock flow.

12. In a method in the operation of a multi-layer headbox including a plurality of stock inlet headers each receiving an individual stock concept and out of which the stock flows further through a distribution manifold into a turbulence generator and further into a slice cone to form a web upon discharge from the slice cone, the improvement comprising preparing the stock of each inlet header from a single fresh stock source by adding the necessary chemicals and fillers into divided portions of the fresh stock in connection with an approach pipe system of the headbox, and transferring longer fibers, in comparison to an average distribution of fibers in the fresh stock, from flows lines through which stock flows into certain inlet headers from which surface layers of the web will be produced to at least one flow line through which stock flows into a respective one of the inlet headers from which an intermediate layer of the web will be produced.

13. The method of claim 12, further comprising the steps of:

screening the stock in the at least one flow line through which stock flows into the respective one of the inlet headers from which an intermediate layer of the web will be produced to separate shorter fibers from longer fibers, in comparison to the average distribution of fibers in the fresh stock, and transferring the separated shorter fibers to the flows lines through which stock flows into the inlet headers from which surface layers of the web will be produced.

14. The method of claim 12, further comprising the step of:

screening the stock in the flow lines through which stock flows into the inlet headers from which surface layers of the web will be produced to separate longer fibers from shorter fibers prior to the step of transferring the longer fibers from the flows lines through which stock flows into the inlet headers from which surface layers of the web will be produced to the at least one flow line through which stock flows into the respective inlet header from which an intermediate layer of the web will be produced.

15. A method for delivery stock to a multi-layer headbox including a plurality of stock inlet headers such that each receives an individual stock concept, comprising the steps of:

directing a flow of fresh stock from a single container, dividing the flow of fresh stock into a first and second surface stock flows and at least one intermediate stock flow, directing the first and second surface stock flows into first and second inlet headers arranged such that a surface layer of a web is formed from the stock of the first and second inlet headers upon discharge of the stock from the headbox, directing the at least one intermediate stock flow into a respective one of the inlet headers arranged such that an intermediate layer of the web between the surface layers of the web is formed from the stock of the respective inlet header upon discharge of the stock from the headbox, adding chemicals, fillers and/or additives to the first and second stock flows and the at least one intermediate stock flow, and transferring longer fibers, in comparison to an average distribution of fibers in the fresh stock, from the first and second surface stock flows to the at least one intermediate stock flow.

16. The method of claim 15, further comprising the steps of:

screening the at least one intermediate stock flow to separate shorter fibers from longer fibers, in comparison to the average distribution of fibers in the fresh stock, and transferring the separated shorter fibers to the first and second surface stock flows.

17. The method of claim 15, further comprising the step of:

screening the first and second stock flows to separate longer fibers from shorter fibers prior to the step of transferring the longer fibers from the first and second stock flows to the at least one intermediate stock flow.

* * * * *